US006170528B1

(12) United States Patent
Junier

(10) Patent No.: US 6,170,528 B1
(45) Date of Patent: Jan. 9, 2001

(54) ASSEMBLY OF ORIFICE CHAMBERS PROGRESSIVELY REDUCING OPERATING PRESSURE FOR LARGE GAS FLOWS

(75) Inventor: Marius Robert Junier, Houston, TX (US)

(73) Assignee: Tapco International, Inc., Houston, TX (US)

( * ) Notice: Under 35 U.S.C. 154(b), the term of this patent shall be extended for 0 days.

(21) Appl. No.: 09/360,608

(22) Filed: Jul. 26, 1999

(51) Int. Cl.[7] ..... F15D 55/00

(52) U.S. Cl. ..... 138/37; 138/39; 181/212; 181/251; 181/268

(58) Field of Search ..... 138/37, 39; 181/212, 181/251, 268

(56) References Cited

U.S. PATENT DOCUMENTS 737,443 * 8/1908 Mooers ..... 181/268
2,682,395 * 6/1954 Calridge et al. ..... 138/37 X
3,016,972 * 1/1962 Dugas ..... 181/268
4,130,173 * 12/1978 Cooksey ..... 138/37 X
4,142,413 * 3/1979 Bellinga ..... 138/37 X

* cited by examiner

*Primary Examiner*—Patrick Brinson
(74) *Attorney, Agent, or Firm*—James F. Weiler

(57) ABSTRACT

Disclosed is an improved assembly of orifice chambers for reducing pressure of large gas flows effective to reduce noise of the gas flows and wear on orifice chambers by progressive pressure drops in the gas flows through successive orifice plates which are releasably secured, preferably by fillet welding, in each of the orifice chambers, removal of one or more orifice plates in an orifice chamber providing manway access to the next succeeding orifice chamber for inspection, repairs, and replacement of the orifice plates thereby reducing the manway opening or access to only one orifice chamber and eliminating separate access manways or manholes for each of the orifice chamber necessary for maintenance of the orifice chambers. Preferably, an internal shell providing an annular space with the body to which the orifice plates are connected is connected to the body by an annular ring and brace by fillet welding in compressions.

11 Claims, 3 Drawing Sheets

ASSEMBLY OF ORIFICE CHAMBERS PROGRESSIVELY REDUCING OPERATING PRESSURE FOR LARGE GAS FLOWS

FIELD OF THE INVENTION

The field of the invention is an assembly of orifice chambers progressively reducing operating pressure of large gas flows having at least one orifice plate in each orifice chamber to take small progressive pressure drops across each orifice plate in lieu of one large pressure drop for reducing wear on each orifice plate and the overall noise.

BACKGROUND OF THE INVENTION

Present orifice chambers utilize an assembly of a number of orifice chambers having orifice plates to progressively reduce the operating pressure of large gas flows, typically flue gas operating from 20 to 40 psig at temperatures ranging from 500 to 1500° F., to atmospheric pressure. Each orifice chamber is equipped with one or more orifices or perforated plates, and typically the assembly has a minimum of two and a maximum of seven orifice chambers having orifice plates in order to progressively take small pressure drops across the orifice plates in each of the orifice chambers in lieu of one large pressure drop. The size of the orifice chambers ranges typically from 30 inches in diameter to 130 inches in diameter. The flowing medium is typically flue gas from a catalytic cracking unit going to the stack outlet of a refinery. The flue gas is a result of the combustion process in a regenerator of a catalytic cracking unit.

The orifice or perforated plates of the orifice chambers require periodic inspection and maintenance and therefore are equipped with a manway or manhole for access to each orifice chamber and the orifice plates or plates secured therein for inspection and maintenance such as repair or replacement, which requires opening and closing each manway or manhole, is time consuming and expensive.

In the following prior art, U.S. Pat. No. 3,712,502 discloses a tanker having internal compartments formed by internal sections 2 which may be welded therein and having openings 10 therethrough; U.S. Pat. No. 3,050,315 discloses a tank having spaced perforated surge plates 4 mounted therein; U.S. Pat. No. 4,611,724 discloses a fluid storage tank with internal welded baffles 20 and perforations to permit fluid to flow through the baffles; U.S. Pat. No. 5,346,092 discloses a tank having welded interior separators 13, 14 and one manhole 12 secured to an inner tank section; U.S. Pat. No. 2,092,490 discloses a welding of interior separating plate 22 within a tank.

The following U.S. Pat. Nos. 710,405, 1,613,746, 1,952,867, 3,250,319, 3,338,238, and 3,425,810 disclose various arrangements for mounting welded interior sections or providing perforations within the sections all within larger chambers.

None of the foregoing prior art orifice chambers and patents disclose or suggest an assembly of orifice chambers for a gradual, progressive, and sequential reduction of operating gas pressures as it flows through a plurality of orifice chambers having removable orifice plates in the orifice chambers and a single access manway or manhole to a first orifice chamber, and access to successive chambers is provided by sequential removal of the orifice plates for maintenance, such as for inspection, repair, and replacement.

It would be highly desirable to provide an improvement in the present assemblies of such orifice chambers which would require only one manway or manhole for the entire assembly for maintenance such as inspection, repair, and replacement of the orifice or perforated plates.

SUMMARY OF THE INVENTION

The present invention is directed to such an improved assembly of orifice chambers for progressive and gradual reduction of operating pressure of gas flow therethrough which requires only one manway or manhole for maintenance, such as inspection, repair, and replacement of the orifice or perforated plates.

The foregoing is accomplished by an assembly of orifice chambers for the progressive and gradual reduction of operating pressures of gas flow such as by flue gas from a catalytic cracking unit to the stack outlet of a refinery, which comprises a body having a flowway, inlet and outlet for the gas to flow through, a plurality of orifice plate supports secured to and extending partially into the flowway spaced from one another in a direction of the gas flow, orifice plates releasably secured to and supported by the support plates thereby forming the orifice chambers, the orifice plates being provided with one or more orifices or perforations effective to provide progressive gradual pressure drops in the gas flow, and a manhole or manway having a releasable closure in the body upstream from the first of the orifice plates so that upon removal of the first of the orifice plates access is provided to the next successive plate, and removal of the next orifice plate provides access to the next successive plate and so on for maintenance, such as inspection, repair, and replacement of each of the orifice plates in the assembly of orifice chambers. Preferably, the orifice plates are secured to an internal annular shell secured to the body by an annular ring providing an annular space between the internal shell and the body allowing for thermal expansion and contraction. Preferably, the orifice plates are releasably secured to the orifice plate supports by fillet welding and can be replaced by fillet welding. Sound dampening or thermal insulation or both can be utilized.

Accordingly, it is an object of the present invention to provide an assembly of orifice chambers having a flowway therethrough for the progressive and gradual reduction of operating pressure of large gas flows through the flowway as previously described in which only a single access manway or manhole for maintenance, such as inspection, repair, and replacement of the orifice plates in the orifice chambers of the assembly is required.

A further object of the invention is the provision of an improved assembly of orifice chambers for the progressive and gradual reduction of operating pressures of gas flow therethrough, each having a removable orifice plate which when removed provides a manway or manhole for access to the next orifice plate for maintenance, such as inspection, repairs, and replacement so that only one manway or manhole is necessary for access for maintenance of each of the orifice chambers of the assembly.

It is a further object of the invention to provide such an improved assembly of orifice chambers which permits thermal expansion and contraction caused by gases flowing through its flowway.

Other and further objects, features, and advantages of the present invention will be apparent from the following description of presently preferred embodiments of the invention taken in conjunction with the accompanying drawings in which the like reference numerals designate like parts throughout several views.

DETAILED DESCRIPTION OF THE INVENTION

Figure 1:
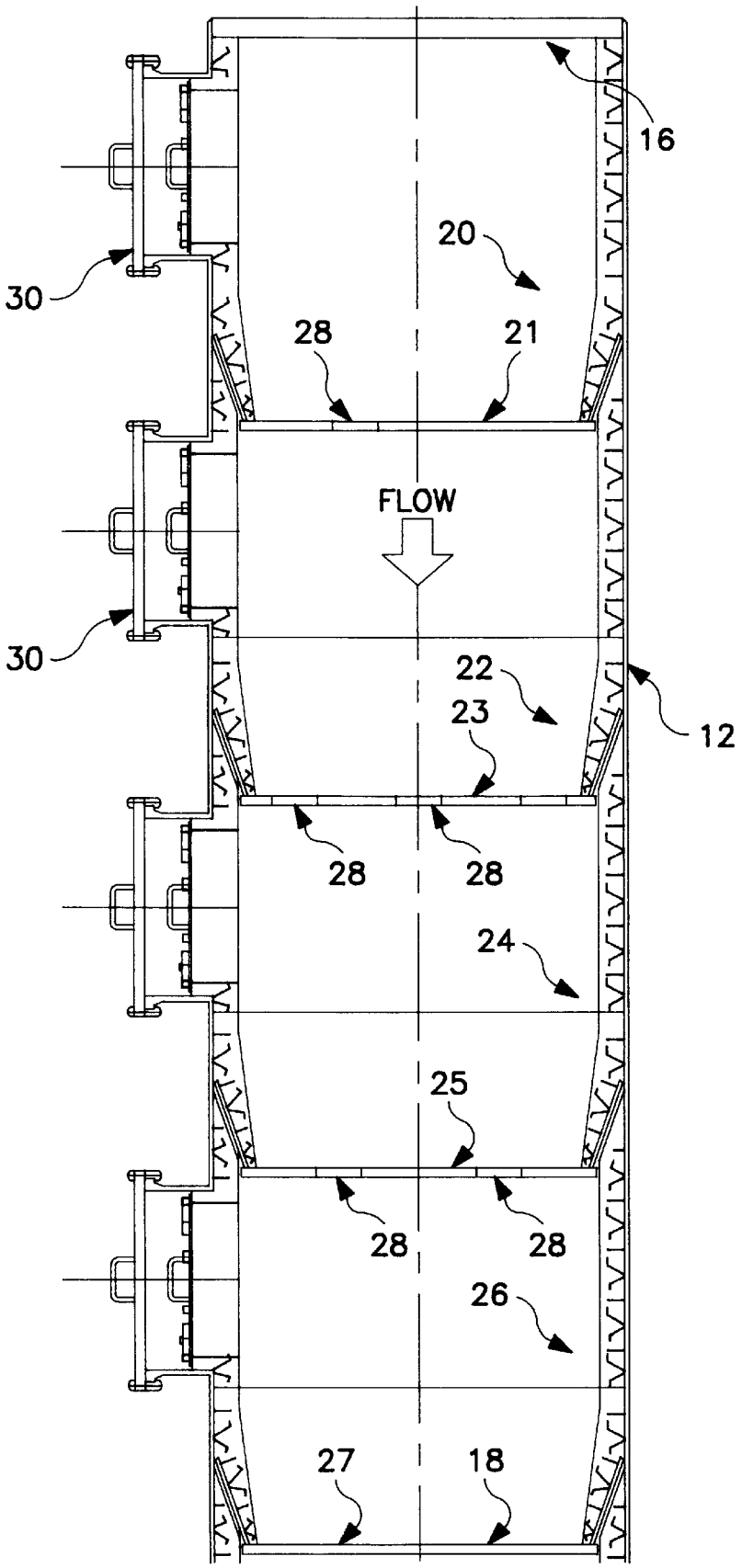
FIG. 1 PRIOR ART
FIG. 1 is a longitudinal view in section of a prior art assembly of orifice chambers currently in use which requires a separate manway or manhole for each orifice chamber for maintenance access to each orifice plate of the orifice chambers.

Referring now to FIG. 1 illustrating a prior art assembly of orifice chambers generally indicated by the reference numeral 10 which includes the body 12 having a flowway 14, entrance 16 and exit 18 for large gas flows therethrough, for example those operating from 20 to 40 psig and at temperatures ranging from 500 to 1500° F. to atmospheric pressure. The flowing medium is typically flue gas from the outlet valve (not shown) of a catalytic cracking unit going to the stack outlet of a refinery (not shown). The flue gas is a result of the combustion process and the regenerator of the catalytic cracking process. The entrance 16 of the body is connected to a flow valve, and the exit 18 is connected to the stack outlet (both not shown). No further description is given or deemed necessary as large gas flows of this type from refineries are well known to those skilled in the art.

As illustrated in FIG. 1, there are four orifice chambers 20, 22, 24, and 26 formed by orifice plates 21, 23, 25, and 27 secured to the body 12 having orifice or perforations 28 (not shown in orifice chamber 26 in this view because of staggering of positions of the orifices in the orifice plate 27) with respect to the other orifice plate. Typically a minimum of two and a maximum of seven orifice chambers are required in order to take progressively small, gradual pressure drops across each orifice plate in lieu of one large pressure drop to reduce wear on each orifice plate and to reduce the overall noise caused by the gas flow. Any number of orifice chambers can be used to accommodate the conditions of use.

These orifice chambers require periodic inspection and maintenance, and therefore each are equipped with inspection manways or manholes 30 in between each of the plates 21, 23, 25, and 27. If any damage is present, then repairs to the orifice plates can only be made in place requiring separate manholes or manways for each orifice plate.

Figure 2:
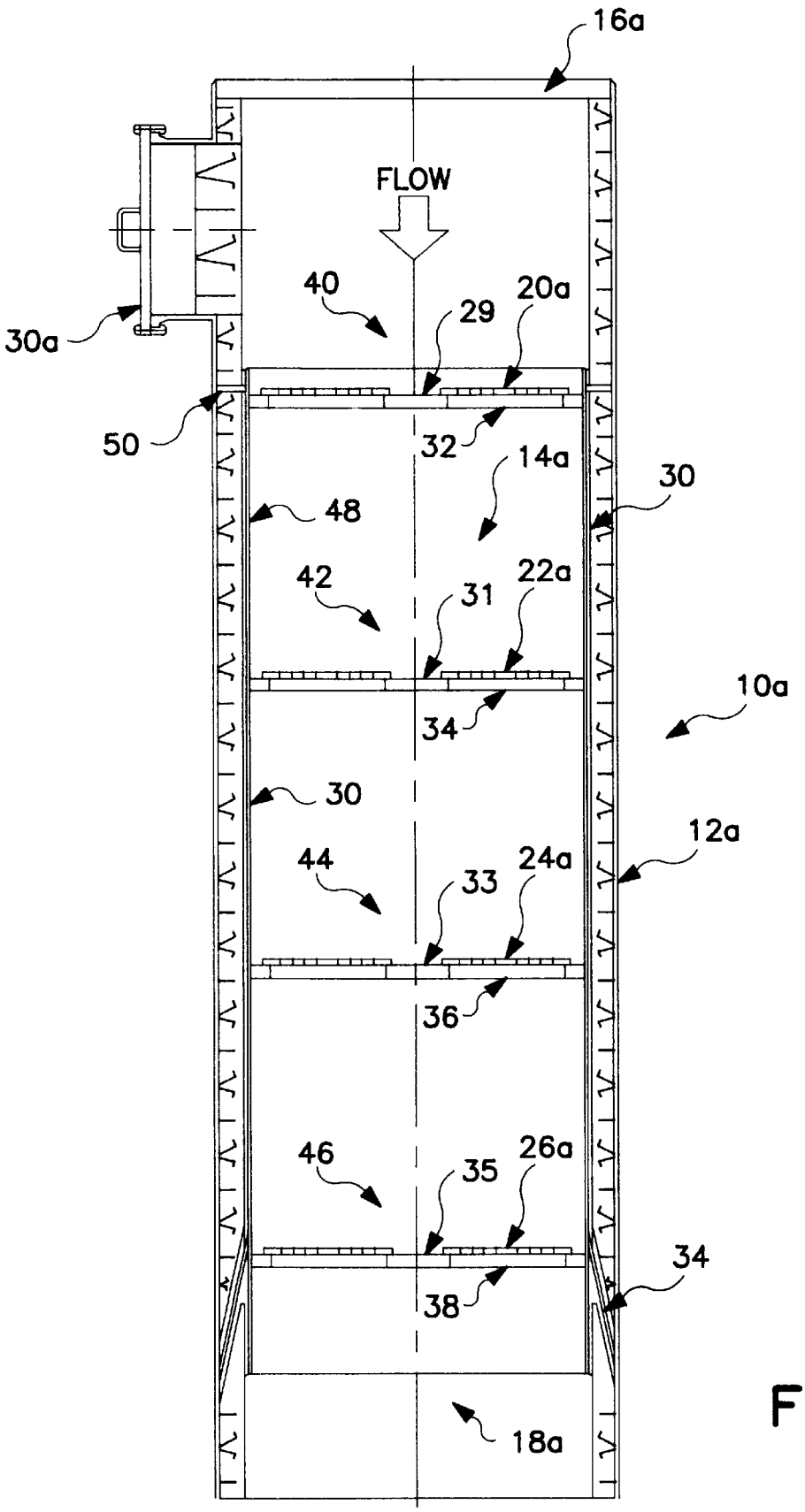
FIG. 2 is a longitudinal view in section of an improved assembly of orifice chambers according to the invention requiring the use of only one manway or manhole for access to all of the orifice chambers for maintenance of the orifice or perforated plates of the assembly.

Referring now to FIG. 2 which illustrates the improved assembly of orifice chambers 10*a* of the present invention and in which reference numerals with the letter "a" designate corresponding parts in FIG. 1, there is a body 12*a*, having the flowway 14*a*, inlet 16*a* and outlet 18*a* for gas flow therethrough such as described in connection with FIG. 1. A series of support plates 29, 31, 33, and 35 are secured to the interior of the body 12*a* by means of an internal shell 48 secured to the body 12*a* by the centering ring 50 and the braces or cone 34 which permit thermal expansion and contraction of the flowway 16*a*. Advantageously, the ring 50 and braces or cone 34 securing the internal shell 48 to the body 12*a* adjacent the inlet and outlet ends 16*a* and 18*a*, respectively, of the flowway 14*a* are secured by fillet welding which is in compressions rather than in tension contrary to prior art. These support plates extend partially into the flowway 14*a* which provide support for the orifice plates 20*a*, 22*a*, 24*a*, and 26*a*, respectively, which are removable as hereinafter described, and provide access manways or manholes 32, 34, 36, and 38 when the removable orifice plates 20*a*, 22*a*, 24*a*, and 26*a* are removed as hereinafter described. These orifice plates provide a series of orifice chambers 40, 42, 44, and 46.

A manway or manhole 30*a* is provided for access into the first orifice chamber 40, removal of the removable orifice plate 20*a* provides an access manway or manhole from orifice chamber 40 into the orifice chamber 42, removal of orifice plate 22*a* provides manway access into the orifice chamber 44, and removal of orifice plate 24*a* provides manway access into orifice chamber 46. Thus, manway access is provided into each of the orifice chambers as described for maintenance, such as inspection and repair or replacement of the orifice plates 20*a*, 22*a*, 24*a*, and 26*a* with only one access manhole or manway 30*a* being required therefor.

Figure 3:
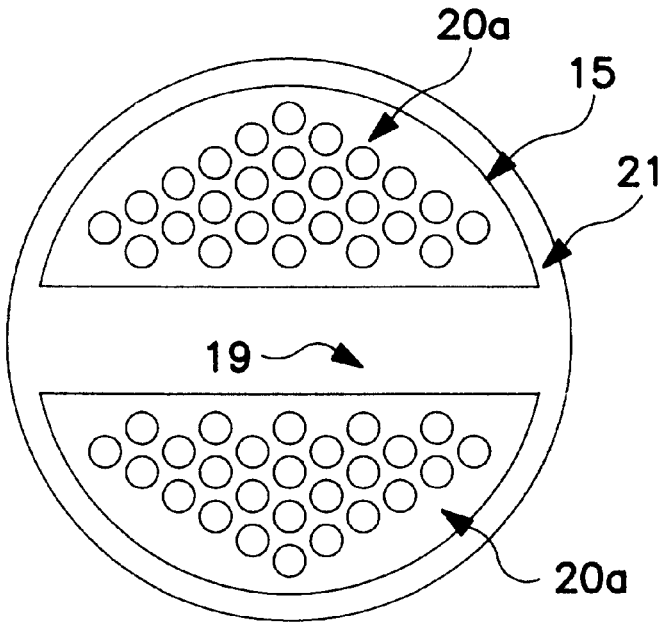
FIG. 3 is a top view of a releasable orifice plate according to the present invention.
Figure 4:
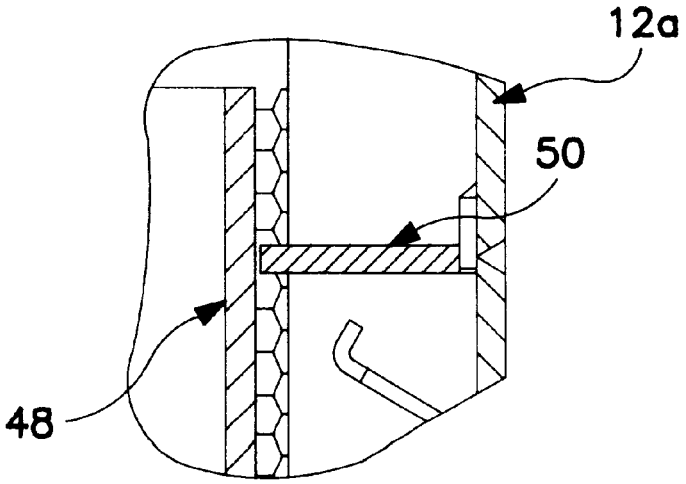
FIG. 4 is a fragmentary, sectional view of a centering ring and an internal shell connecting the orifice plates or perforated plates to the body of the assembly of orifice chambers permitting thermal expansion and contraction of the flowway.

FIG. 3 illustrates the construction of a preferred removable orifice plate, an example of which is the orifice plate 20*a* in chamber 40 which includes a support ring 21 having a cross member 19, which support ring 21 preferably is secured by welding 15 to the interior wall 17 of the body 12*a*. The orifice plate 20*a* is releasably secured to the orifice support plate 21, preferably by fillet welding 15 so that the orifice plates 20*a* may be removed by cutting the fillet weld 15. This permits access through the manway opening 32 to provide access into the orifice chamber 42.

The remaining plate support members and removable orifice plates are the same as described and can be sequentially removed to provide access into each of the following orifice chambers 44 and 46. Thus, the orifice plates can be accessed for inspection, repair, and replacement simply by utilization of a single manway or manhole and removal of the orifice plates as described. The manway or manhole 30*a* has a releasable closure (as do those in FIG. 1) which is removed and replaced for such access. The releasable closures are conventional, and no further description thereof is deemed necessary or given.

Any type of suitable material for noise or thermal insulation can be used. For example, any refractory material having sufficient strength can be used for the liner, which materials are available from a number of suppliers including Harbison Walker (Pittsburgh, Pa.), National Refractories (Oakland, Calif.), Norton Co. (Worchester, Mass.), The Carborundum Co. (Niagara Falls, N.Y.), Resco Products, Inc. (Morristown, Pa.) Plibrico (Chicago, Ill.), and A. P. Green (Mexico, Mo.).

For noise dampening ceramic fibrous materials such as Kaowhool from Thermal Ceramics of Augusta, Ga., or other suitable materials can be used.

Accordingly, no further description is deemed necessary or given as noise dampening and thermal insulation materials are readily available on the open market.

For reducing the operating pressure of large gas flows in the range of from 20 to 40 psig at temperatures ranging from 500 to 1500° F. to atmospheric pressure, typically a minimum of two and a maximum of seven orifice chambers are satisfactory in order to take progressive small pressure drops across each orifice plate in lieu of one large pressure drop. For these gas flows, the size of the orifice chambers ranges typically from 30 inches diameter to 130 inches diameter. Preferably, the openings or perforations in the plate are staggered with respect to one another in the direction of flow through the successive orifice chambers. The orifices or perforations in the orifice plates may vary from plate to plate.

The following is an example of satisfactory low areas calculation for flue gas valve and orifice chambers utilizing four orifice chambers.

EXAMPLE 1

Flow Gas Valve with Orifice Chambers

| FLOW #/HR | M.W. | P1 PSIG | DIFF. P PSI | TEMP. DEG. F. | DISCH. COEFF. | OPEN % | AREA IN2 | VALVE OR HEAD # |
|---|---|---|---|---|---|---|---|---|
| 250000 | 29 | 35 | 10.2 | 1350 | .9 | 50 | 301 | FG VALVE |
| 250000 | 29 | 24.8 | 8.14 | 1340 | .75 | 100 | 226 | 1 Orifice chamber |
| 250000 | 29 | 16.67 | 6.45 | 1330 | .75 | 100 | 284 | 2 Orifice chambers |
| 250000 | 29 | 10.22 | 5.15 | 1320 | .75 | 100 | 356 | 3 Orifice chambers |
| 250000 | 29 | 5.07 | 4.07 | 1310 | .75 | 100 | 448 | 4 Orifice chambers |

From the above Example 1, the sequential pressure drop through the four orifice chambers indicated in the columns entitled "PI PSIG" and "DIFF.P PSI" dropped from 35 and 10.2 psig to 5.07 and 4.07 psig which substantially reduced the noise and wear on the orifice plates to the sequential incremental pressure drops indicated.

The improved orifice chambers can be utilized with a wide range of gas pressures, temperatures, and flow rates modified as to size, number, and arrangement to accommodate the circumstances of use.

The present invention, therefore, is well suited and adapted to attain the objects and the ends and has the advantages and features mentioned as well as others inherent therein.

While presently preferred embodiments of the invention have been given for the purpose of disclosure, changes may be made which are within the spirit of the invention as defined by the scope of the appended claims.

What is claimed is:

1. An improved assembly of orifice chambers for the progressive reduction of operating pressures of gas flow effective to reduce noise of the gas flow and wear on the orifice chambers comprising, a body having a flowway, an inlet and an outlet for the gas flow therethrough, a plurality of orifice plate supports secured in and extending partially into the flowway spaced from one another in the direction of the gas flow, one or more orifice plates releasably secured and supported by the orifice support plates thereby forming the orifice chambers, removal of one or more of the orifice plates providing an access manway to the next succeeding orifice chamber in the direction of the gas flow, the one or more orifice plates provided with one or more orifices effective to provide a gradual progressive pressure drop in the gas flow as it flows successively through the orifices in the orifice plates, and a manway having a releasable closure in the body upstream from the orifice chambers thereby providing access to first of the orifice chambers and removal of the one or more orifice plates of the first and successive orifice chambers in the direction of the gas flow provides the access manway to the next successive orifice chambers and their orifice plates.

2. The improved assembly of orifice chambers of claim 1 where, the orifice plates are releasably secured to and supported by the support plates by welding.

3. The improved assembly of orifice chambers of claim 1 where, the orifice plate supports comprise an annular structure with a cross member which provides the access manway openings when the orifice plates are removed from the orifice plate supports.

4. The improved assembly of orifice chambers of claim 1 including, thermal insulation secured to the body around the flowway.

5. The improved assembly of orifice chambers of claim 1 including, sound dampening material secured in the body around the flowway.

6. An improved assembly of orifice chambers for the progressive reduction of operating pressures of gas flow effective to reduce noise of the gas flow and wear on the orifice chambers comprising, a body having a flowway, an inlet and an outlet for the gas flow therethrough, an annular internal shell secured in the flowway to the body by a centering ring adjacent the inlet and a brace adjacent the outlet, spacing the internal shell from and providing an annular space with the body effective to permit thermal expansion and contraction of the internal shell caused by the gas flow in the flowway, a plurality of orifice plate supports secured to the annular internal shell and extending partially into the flowway spaced from one another in the direction of the gas flow, one or more orifice plates releasably secured and supported by the orifice support plates thereby forming the orifice chambers, removal of one or more of the orifice plates providing an access manway to the next succeeding orifice chamber in the direction of the gas flow, the one or more orifice plates provided with one or more orifices effective to provide a gradual progressive pressure drop in the gas flow as it flows successively through the orifices in the orifice plates, and a manway having a releasable closure in the body upstream from a first of the orifice chambers and the annular internal shell thereby providing access to the first of the orifice chambers and removal of the one or more orifice plates of the first and successive orifice chambers in the direction of the gas flow and provides the access manways to the next and the successive orifice chambers and their orifice plates.

7. The improved assembly of orifice chambers of claim 6 where, the orifice plates are releasably secured to and supported by the support plates by welding.

8. The improved assembly of orifice chambers of claim 6 where, the orifice plate supports comprise an annular structure with a cross member which provides the access manway openings when the orifice plates are removed from the orifice plate supports.

9. The improved assembly of orifice chambers of claim 6 including, thermal insulation secured to the body around the flowway and disposed in the annular space.

10. The improved assembly of orifice chambers of claim 6 including, sound dampening material secured in the body around the flowway and disposed in the annular space and around the centering ring.

11. The improved assembly of orifice chambers of claim 6 where, the centering ring and brace secure the internal shell to the body by fillet welding in compression as a result of gas flow through the flowway.

* * * * *